US006672486B2

(12) United States Patent
Santagiuliana

(10) Patent No.: US 6,672,486 B2
(45) Date of Patent: Jan. 6, 2004

(54) MULTIDOSE DELIVERY PUMP

(75) Inventor: Stefano Santagiuliana, Caldogno (IT)

(73) Assignee: Taplast SpA, Dueville (IT)

( * ) Notice: Subject to any disclaimer, the term of this patent is extended or adjusted under 35 U.S.C. 154(b) by 0 days.

(21) Appl. No.: 10/239,759

(22) PCT Filed: Apr. 12, 2001

(86) PCT No.: PCT/EP01/04224

§ 371 (c)(1),
(2), (4) Date: Nov. 1, 2002

(87) PCT Pub. No.: WO01/78903

PCT Pub. Date: Oct. 25, 2001

(65) Prior Publication Data

US 2003/0116588 A1 Jun. 26, 2003

(30) Foreign Application Priority Data

Apr. 13, 2000 (IT) ..... VI2000A0065

(51) Int. Cl.[7] ..... B65D 11/00
(52) U.S. Cl. ..... 222/207; 222/209; 222/321.7
(58) Field of Search ..... 222/207, 211, 222/209, 321.7

(56) References Cited

U.S. PATENT DOCUMENTS 5,050,782 A * 9/1991 Cheng ..... 222/309
5,224,627 A * 7/1993 Weag ..... 222/183
5,503,017 A * 4/1996 Mizukoshi ..... 73/514.36

FOREIGN PATENT DOCUMENTS

| | | | |
|---|---|---|---|
| FR | 1101114 | * | 9/1955 |
| GB | 1106238 | * | 3/1968 |
| WO | 96/28257 | * | 9/1996 |

* cited by examiner

*Primary Examiner*—Philippe Derakshani
(74) *Attorney, Agent, or Firm*—Dykema Gossett PLLC

(57) ABSTRACT

The invention relates to a delivery pump to be coupled to the neck of a container filled with a liquid to be delivered comprising: a hollow body defining a suction and compression chamber for the liquid having a suction duct for the liquid, a tight piston sliding in the hollow body, a delivery duct for the liquid communicating with the suction and compression chamber; calve mechanism adapted to regulate inflow and outflow of liquid into and from the suction and compression chamber, elastic mechanism arranged between the tight piston and the hollow body. The delivery pump comprises first constraint mechanism fixed to the hollow body and selectively cooperating with second constraint means fixed to the tight piston to define the stroke of said tight piston. The stroke can be varied according to the mutual position of the first and second constraint mechanism.

13 Claims, 8 Drawing Sheets

MULTIDOSE DELIVERY PUMP

The present invention relates to a multidose delivery pump provided with means for the removable coupling with the neck of a container filled with a liquid, particularly adapted to deliver variable doses of food ingredients or detergents.

It is known that hygienic and practical requirements resulted in a considerable spread on the market of containers for liquids provided with distributors or delivery means to be actuated manually by the user.

The known delivery pumps substantially comprise a hollow body defining a suction and compression chamber and provided with a liquid suction duct.

A tight piston is slidingly coupled to the hollow body and internally provided with a liquid delivery duct communicating with outside and the suction and compression chamber.

Valve means generally consisting of metal balls, are arranged downstream and upstream the suction duct and the delivery duct respectively, and regulate inflow and outflow of the liquid to and from the suction and compression chamber.

Elastic means generally consisting of spiral springs, are also arranged between the hollow body and the piston and provide for the piston return to the rest position when the delivery is over.

In operation the user acting on the piston loades the elastic means and compresses the liquid contained in the suction and compression chamber at the same time opening the delivery duct and allowing the outflow of the liquid to the outside.

When the tight piston reaches the bottom of the suction and compression chamber, it is released by the user so as to allow the elastic means to return the piston to the starting rest position.

The elastic return of the piston generates a vacuum inside the suction and compression chamber, opening the liquid suction ducts and closing the delivery duct so as to allow inflow of liquid inside the chamber and preparing the pump for the next delivery.

A duct communicating with outside allows to restore the pressure inside the container.

It is important to note that the maximum amount of liquid to be delivered is substantially equal to the volume of the suction and compression chamber and is proportional to the stroke travelled by the piston under the action of the user. A first drawback of the above mentioned delivery pump of known type above mentioned consists in that the pump delivers when used in the traditional way, a fixed amount of liquid equal to the volume of the suction and compression chamber.

Indeed when the user needs a smaller quantity of liquid, he must manually control in a sensorial way his action on the piston by releasing it in advance as soon as the desired quantity of liquid is reached.

This is particularly important when the liquid to be delivered is for instance a sauce such as ketchup, mustard or the like.

Another drawback linked to the preceding one consists in that to cover the market demand, the manufacturers must make several different models of pumps which differ only for the amount of liquid that can be delivered.

This involves a considerable increase of the number of models to be manufactured with a consequent increase of problems of production and management of the whole production cycle and stockage of the pump.

Another drawback consists in that the elastic means are generally metal spiral springs which prevent a direct recycle of the pump which is possible only after a previous separation of the members made of metal materials from the members made of plastic material.

The object of the present invention is to overcome the foregoing drawbacks. More particularly a first object is to provide a delivery pump that with the same components allows to deliver predetermined amounts of liquid by actuating the pump in a non-sensorial way, causing the piston to reach always the stroke end.

Another object is to provide a pump whose quantity to be delivered is predetermined at the time of assembling the pump or applying it to the container.

Another object is to provide a pump whose quantity of liquid to be delivered may be regulated also by the user in a simple, quick and precise way.

Another object is to provide a pump that after its use can be immediately and fully recycled without any previous disassembling operation or the like.

Another object is to provide a pump which is particularly easy to be used and reliable.

A last but not least object is to provide a pump which is particularly cheap and of easy construction and assembling, suitable for the mass production The above mentioned objects are attained by a delivery pump provided with means for the removable coupling to the neck of a container for the liquid to be delivered the main features of which are according to claim 1.

Advantageously as the delivery pump of the invention can vary the piston stroke, it allows to reduce considerably both the production and stockage cost due to pumps of different capacity. Indeed the pump allows to combine in a single pump, models with different characteristics of delivery.

Still advantageously the invention allows the user to actuate the pump always at the stroke end so as to obtain the precise quantity of liquid selected without being compelled to operate in a sensorial way on the piston as it happens now for the known pumps.

The above mentioned objects and advantages will be more apparent from the description of a preferred embodiment of the invention which is given as an illustrative and non-limiting example making reference to the accompanying sheets of drawings in which.

Figure 1:
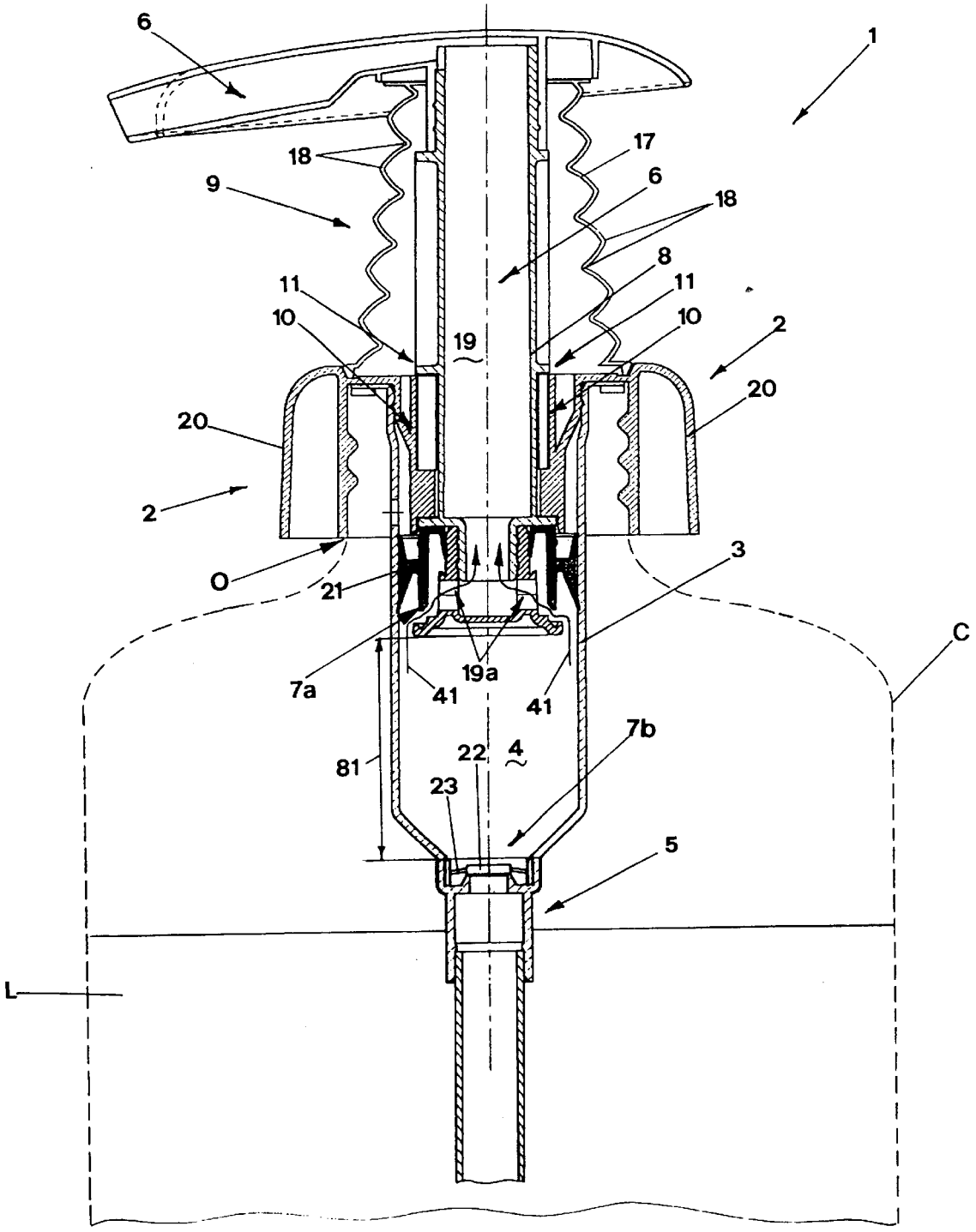
FIG. 1 is a longitudinal section of the pump of the invention.

The delivery pump of the invention is shown in FIG. 1 where it is indicated generally with reference numeral 1. The pump is provided with means 2 for the removable coupling to the neck O of a container C filled with a liquid L to be delivered, said means being generally constituted by a plug 20 to be screwed on the neck O of the container C.

The pump comprises also a substantially cylindrical hollow body 3 defining a, suction and compression chamber 4 for the liquid L and having a suction duct 5 for said liquid L.

A delivery duct 6 of the liquid L communicates with the suction and compression chamber 4 and allows delivery of said liquid L while valve means generally indicated with numerals 7*a* and 7*b* and arranged upstream the suction duct 5 and downstream the delivery duct 6 respectively, regulate inflow and outflow of liquid L in and from said chamber 4.

A tight piston 8 is slidingly coupled to the hollow body 3 and cooperates with elastic means 9 arranged between said piston 8 and the hollow body 3 to allow inflow and outflow of liquid L in and from chamber 4.

Figure 2:
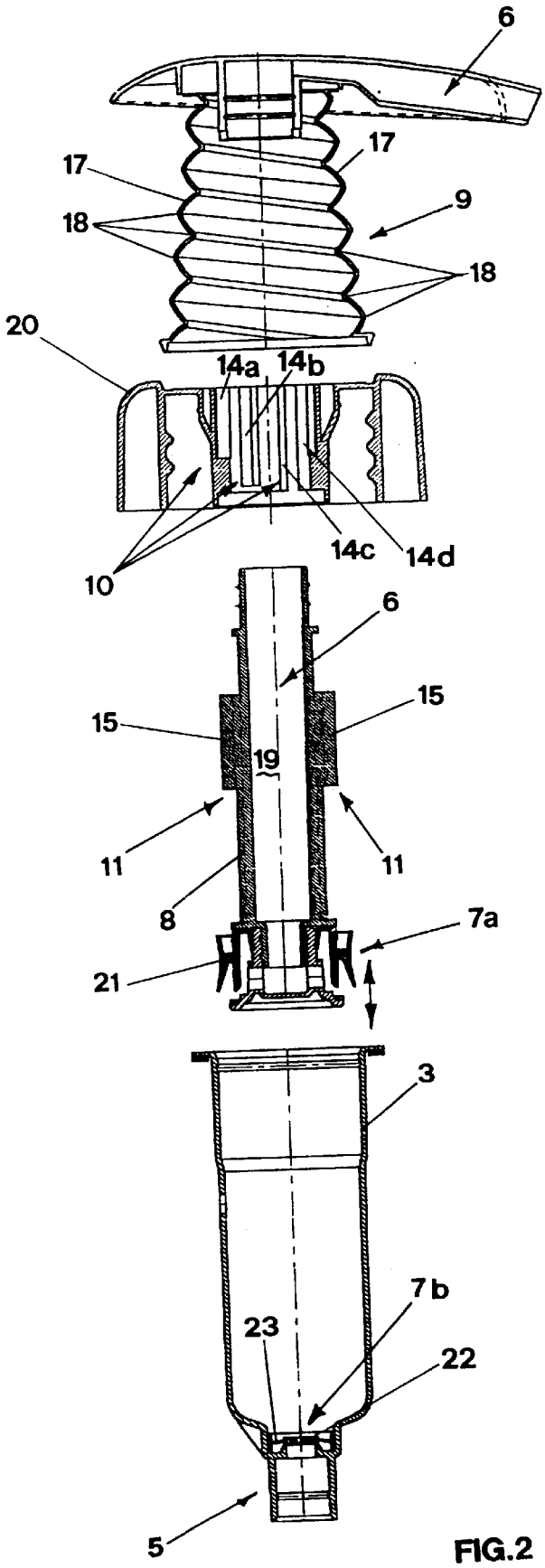
FIG. 2 is an exploded longitudinal section of the pump of FIG. 1.

The delivery pump 1 of the invention is provided with first constraint means 10 fixed to the hollow body 3 to be seen in detail in FIG. 2, cooperating selectively with second constraint means 11 fixed to piston 8, which means 10 and 11 modifying their mutual position allow to vary the amount of liquid L to be delivered by changing the stroke 81 of piston 8.

More particularly the first constraint means 10 belong to the plug 20 while the second constraint means 11 belong to the tight piston 8.

Figure 3:
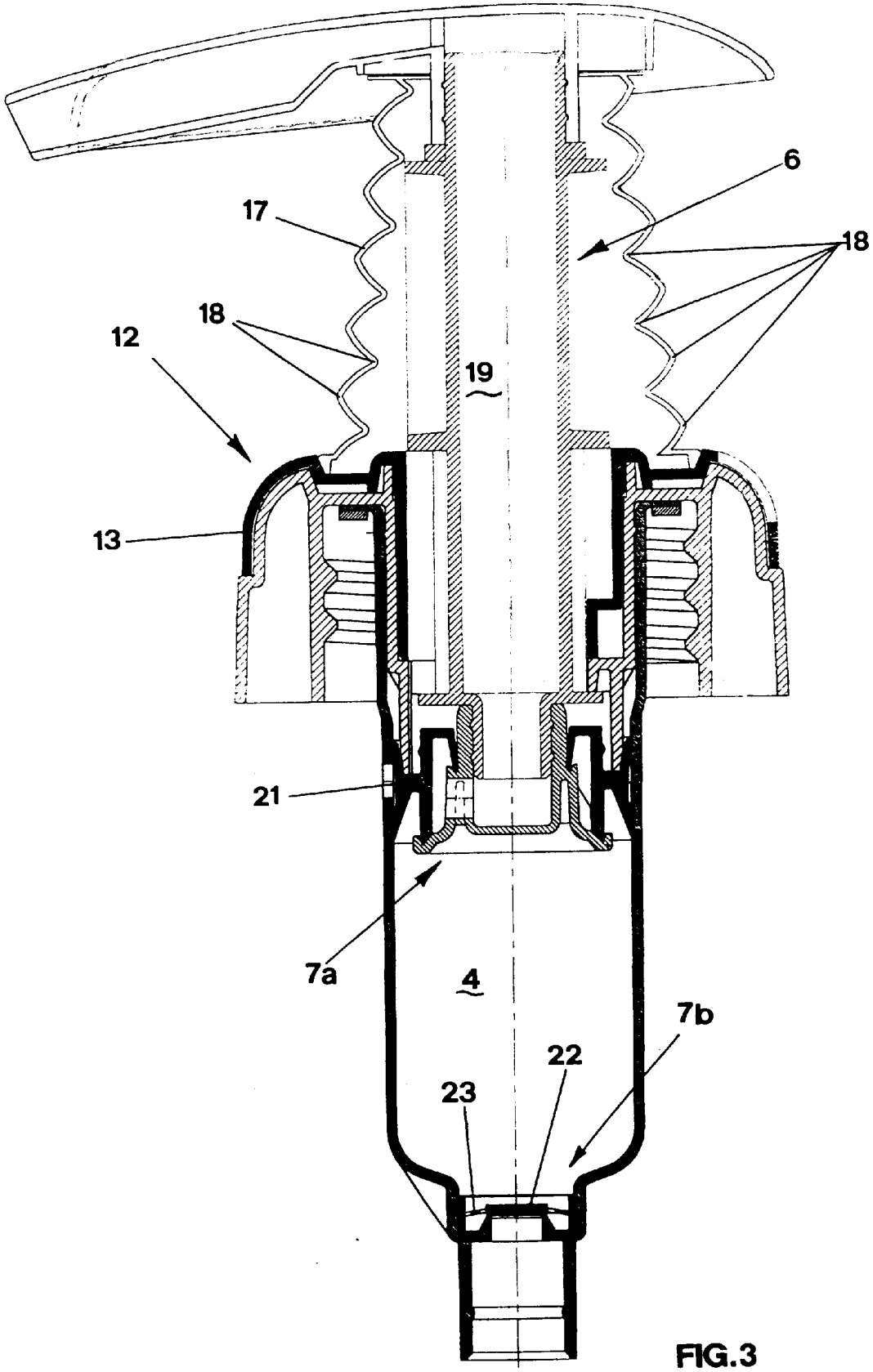
FIG. 3 is a longitudinal section of a constructional variation of the pump of FIG. 1.
Figure 4:
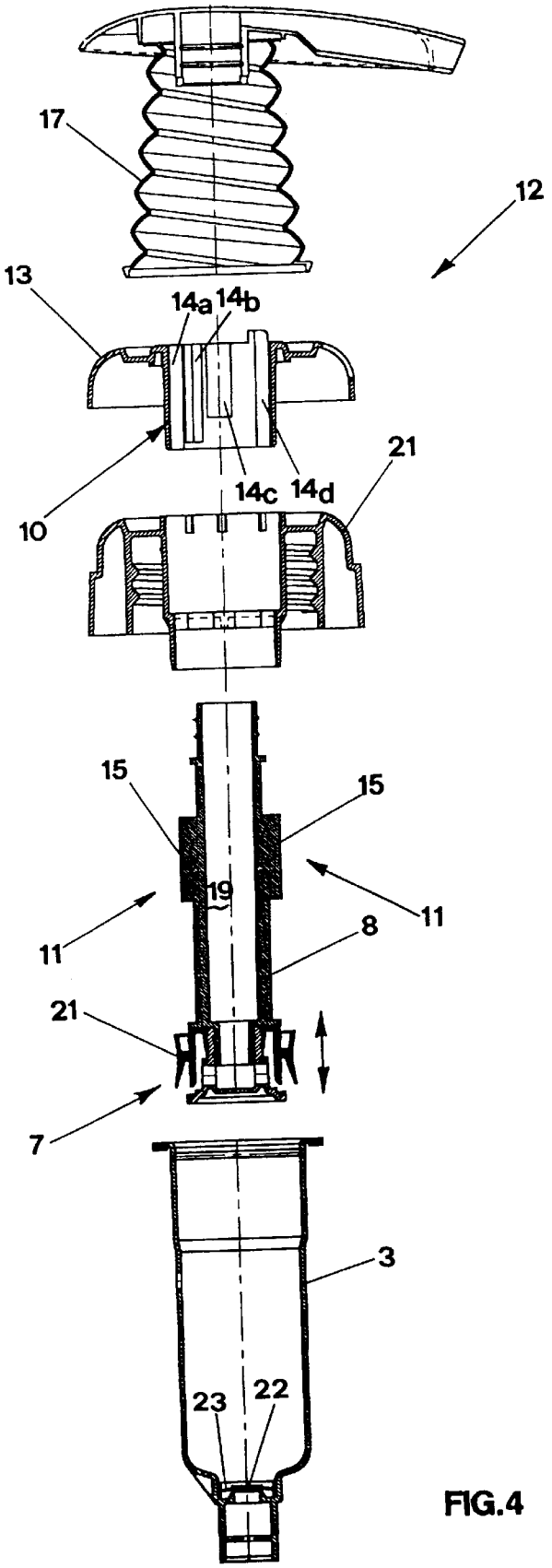
FIG. 4 is an exploded sectional view of the pump of FIG. 3.
Figures 5, 6, 7, 8:
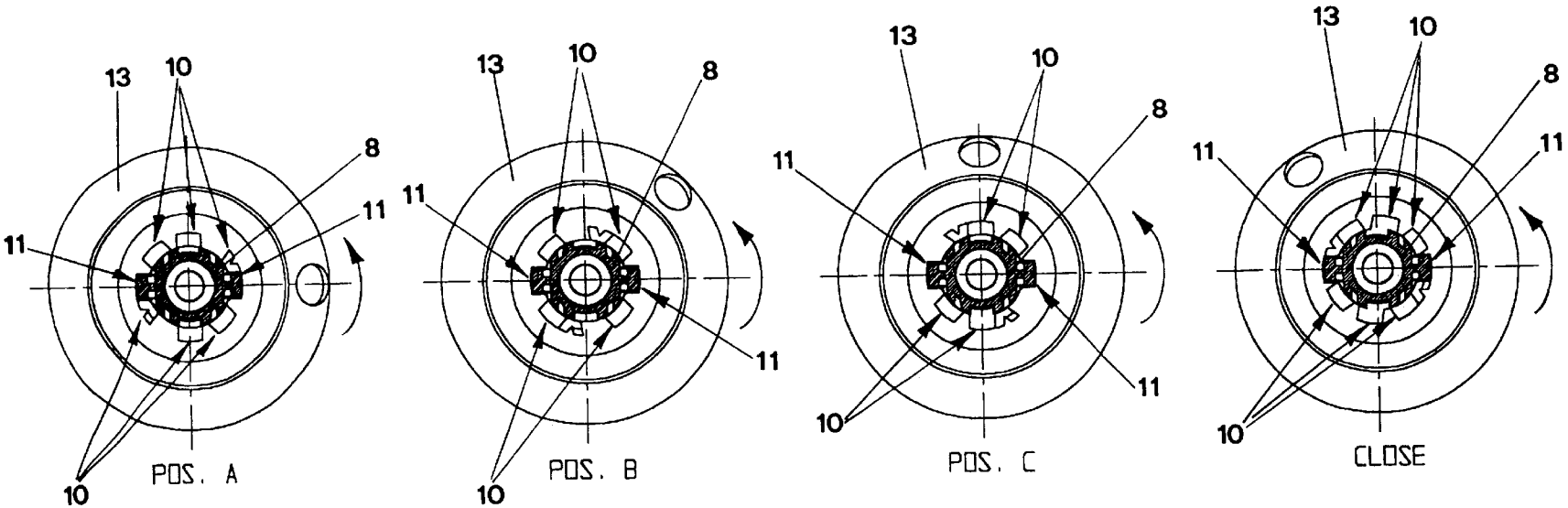
FIGS. 5 to 8 are plan views of some elements of the pump of FIG. 3.

According to a first constructional variation shown in detail in FIGS. 3 and 4, the first constraint means 10 belong to selection means 12 to be actuated manually by the user, allowing to select one of predetermined mutual positions of the constraint means 10 and 11.

In the example of FIG. 4 the selection means 12 consist of a ring nut 13 rotably coupled to plug 21 that the user, as shown in detail in FIGS. 5, 6, 7 and 8, may set at three different positions indicated with characters A, B, C and the position CLOSE. By rotating the ring nut as shown in FIGS. 5 to 8, the user changes the mutual position of the first and second constraint means 10 and 11 so as to change the maximum quantity of liquid to be delivered.

As to the first constraint means 10 to be seen in FIGS. 2 and 4, they consist of a plurality of vertical grooves 14*a*, 14*b*, 14*c* and 14*d* of different length made on plug 20 (FIG. 2) or on ring nut 13 (FIG. 4) respectively, while the second constraint means 11 consist of two projecting elements 15 belonging to the tight piston 8 and adapted to be slidingly coupled to grooves 14*a*, 14*b*, 14*c*, and 14*d*.

Figure 9:
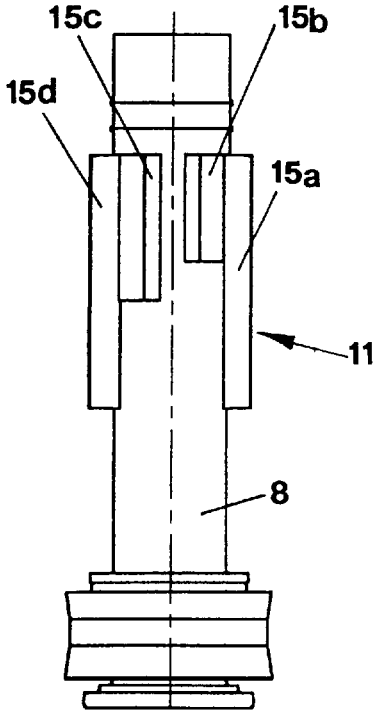
FIGS. 9 and 10 are two constructional variations of an element of the pump of FIG. 1 or FIG. 3.

According to a constructional variation shown in detail in FIG. 9, the projecting elements 15*a*, 15*b*, 15*c* and 15*d* may have different lengths, and in this case obviously the grooves on plug 20 or ring nut 13 may indifferently be of equal or different length.

Figure 10:
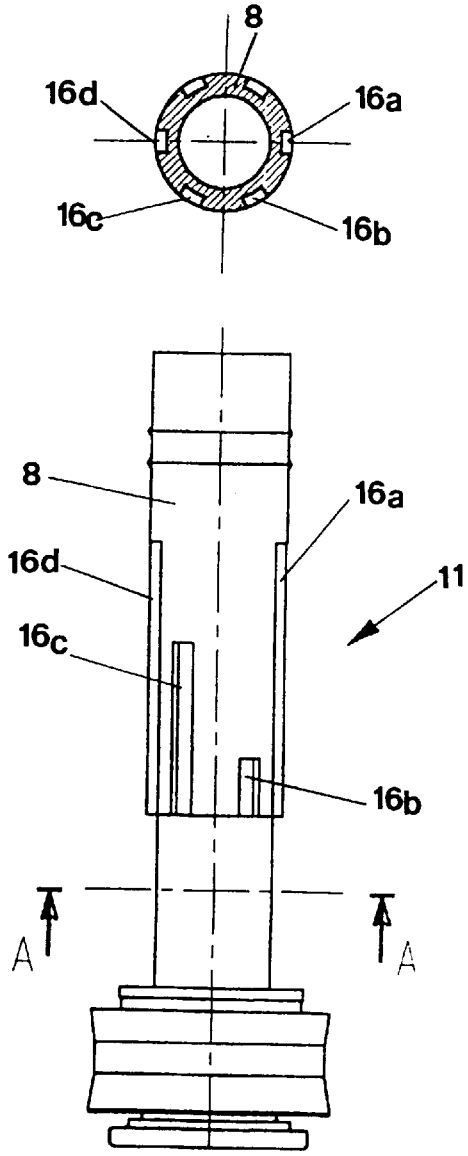

According to another constructional variation in detail in FIG. 10, the second constraint means 11 may consist of grooves of different length 16*a*, 16*b*, 16*c* and 16*d* made on the stem of piston 8 and adapted to receive corresponding projections not shown in the drawings and obviously belonging to plug 20 or ring nut 13.

As to elastic means 9, they consist of a bellows spring 17 made of plastic material and preferably having a frustum conical or cylindrical shape and provided with a perimetral spiral rib 18.

As shown in FIG. 1, a delivery duct 6 constituted by a tubular chamber 19 made inside the tight piston 8, connects through the valve means 7*a*, the suction and compression chamber 4 with the outside.

The valve means 7*a* comprise a second piston 21 slidingly couple to the tight piston 8 which moves vertically closing and opening the communication channel 19*a* so as to prevent or allow inflow of liquid L along the route 41 in the tubular channel 19.

A further valve element 7*b* is then arranged near the bottom of the suction and compression chamber 4 and regulates inflow of liquid L in said chamber 4.

The valve element 7*b* consists of a substantially flat main body 22 provided on its periphery of elastic projecting spokes 23 substantially coplanar to the body and adapted to be opposed to the walls of the hollow body 3 and to allow the main body 22 to rise in order to open the suction duct 5.

Figure 15:
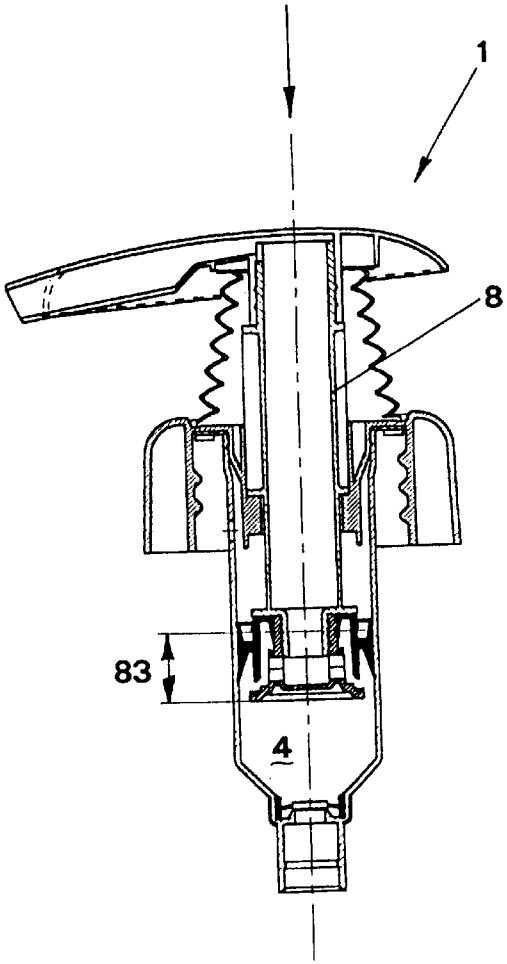
FIGS. 13 to 15 are views of three different working phases of the pump of FIG. 1.
Figure 14:
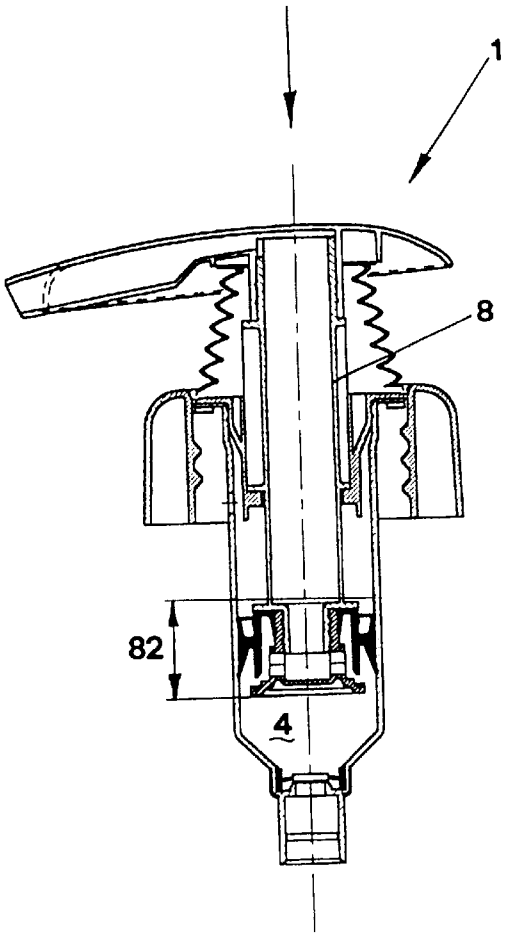
Figure 13:
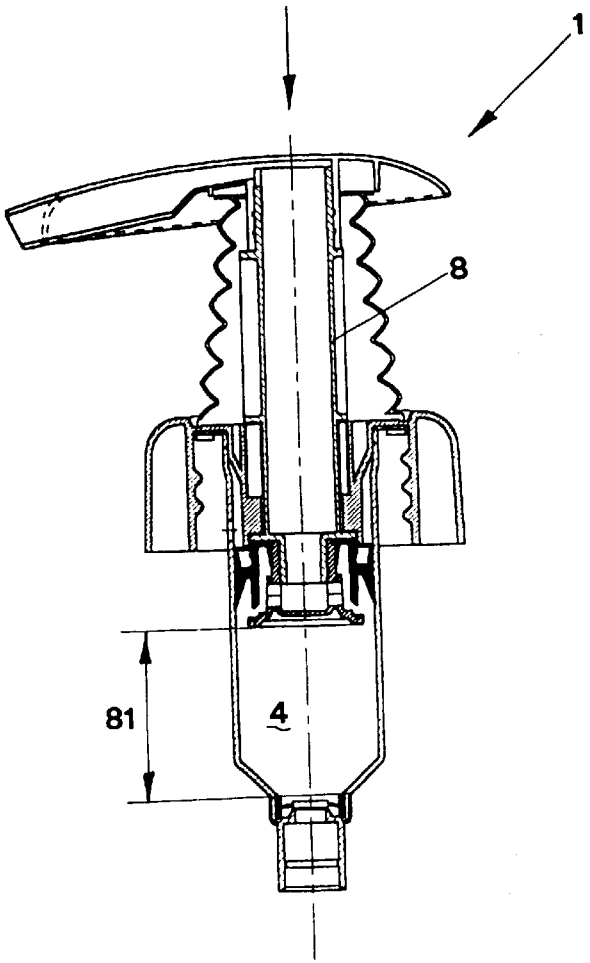

Assembly of the pump of FIGS. 1 and 2 provides, as shown in detail in FIGS. 13, 14 and 15, that the operator couples the projecting elements 15 with one of the corresponding grooves 14*a*, or 14*b* or 14*c*.

As clearly shown in FIGS. 13 to 15 the stroke 81, 82, 83 of piston 8 changes as a function of the length of the selected groove 14*a*, 14*b*, 14*c*, so as to vary the maximum quantity of liquid L that can be delivered by the pump 1. More particularly the different length of the grooves 14*a*, 14*b*, 14*c* allows to change the bottom dead center of piston 8 so as to change its stroke and consequently the amount of delivered liquid L.

In operation the user, as shown in FIGS. 13 to 15, pushes downwards the piston 8 closing the suction channel 5 through the valve means 7*a* and pressing the liquid L contained in chamber 4 at the same time allowing inflow into the delivery channel 6.

When the piston 8 comes to the bottom dead center defined as previously stated by the length of the selected groove 14*a*, 14*b*, 14*c*, it is released by the user so as to allow to the now loaded spring 17 to return it to the starting rest position.

The elastic return of piston 8 generates a vacuum inside the chamber 4 actuating the valve means 7*a* and 7*b* so as to close the delivery duct 6 and open the suction duct 5 thus allowing inflow of liquid L inside the chamber 4 preparing the pump 1 to the next delivery.

Figure 12:
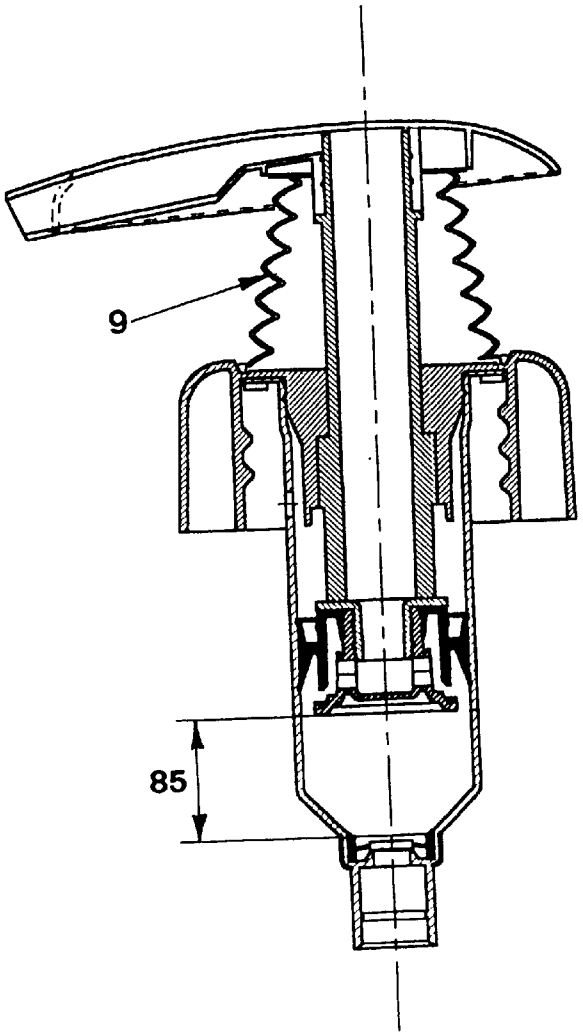
FIGS. 11 and 12 are longitudinal sections of another constructional variation of the pump of FIG. 1.
Figure 11:
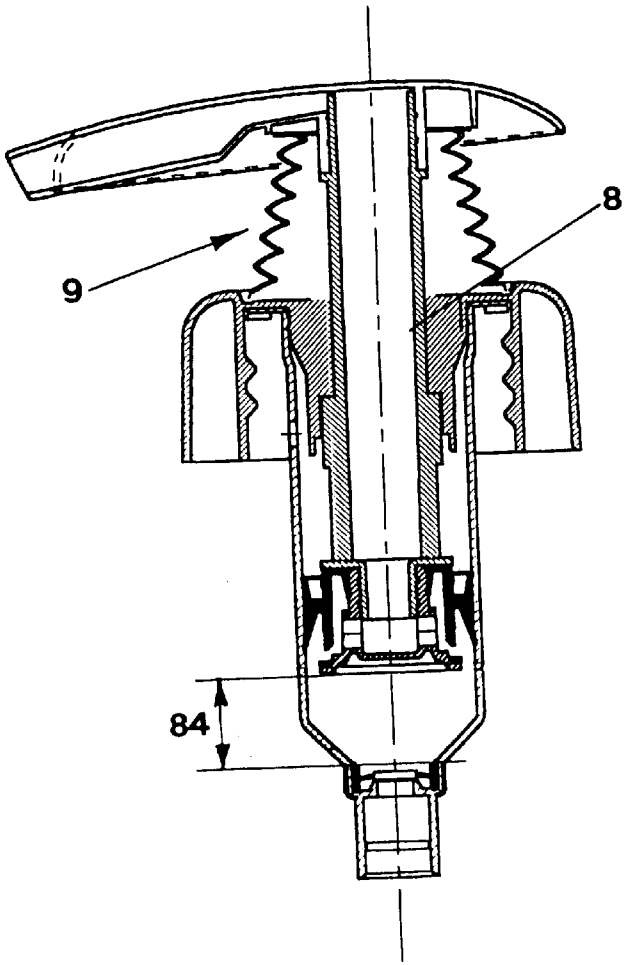

A further constructional variation shown in detail in FIGS. 11 and 12 differs from the preceding ones because the stroke 84, 85 of the tight piston 8 is changed by varying the position of the top dead center of the tight piston 8.

It is important to note that in these conditions the elastic means do not work in an optimal way because they are compressed for the most part of the time and therefore could undergo possible loss of their elastic properties.

As to the pump of FIGS. 3 and 4, it is provided that once assembled the user may change the quantity of liquid to be delivered simply rotating the ring nut 13 before actuating the piston 8.

A further constructional variation provides that the tight piston is free to rotate. In this case the user may act on the piston when this piston is in the rest position of the pump of FIG. 1, or at the bottom dead center for the pump of FIGS. 11 and 12, and rotating the piston the mutual position of the constraint means and therefore the quantity of liquid to be delivered is varied in this way. It is to be understood that the foregoing is valid also for the other constructional variations described hereinbefore.

From the foregoing it is clear that the illustrated delivery pump attains the appointed objects.

Although the invention was described with reference to the accompanying drawings, it may undergo constructional modifications falling in the appended claims and therefore covered by the present patent.

What is claimed is:

1. A delivery pump provided with a plug for the removable coupling to the neck of a container filled with a liquid to be delivered comprising:

a hollow body defining a suction and compression chamber for said liquid having at least one suction duct for said liquid;

a tight piston sliding in said hollow body to cause inflow and outflow to said liquid into and from said suction and compression chamber;

at least a delivery duct for said liquid communicating with said suction and compression chamber;

valve means arranged downstream said suction duct and upstream said delivery duct respectively, adapted to regulate inflow and outflow of said liquid into and from said suction and compression chamber;

elastic means arranged between said tight piston and said hollow body;

first constraint means belonging to said plug cooperating selectively with second constraint means belonging to said tight piston to define the stroke of said piston, said stroke being variable according to the mutual position of said first and second constraint means, wherein said plug holds a ring nut rotably coupled to said plug, said ring nut being provided with one or more said first constraint means to be coupled to said second constraint means.

2. The pump according to claim 1 wherein said first constraint means belonging to said ring nut are one or more grooves of different length and said second constraint means belonging to said piston are one or more projecting elements belonging to said tight piston adapted to be slidingly coupled to at least one of said grooves.

3. The pump according to claim 1 wherein said first constraint means belonging to said ring nut are one or more grooves of equal length and said second constraint means belonging to said piston, are one or more projecting elements of different length.

4. The pump according to claim 1 wherein said first constraint means belonging to said ring nut are at least one projection and said second constraint means belonging to said piston, are one or more grooves of different length.

5. The pump according to claim 1 wherein said elastic means consist of a bellows spring made of plastic material.

6. The pump according to claim 5 wherein said bellows spring is of a frustum conical shape.

7. The pump according to claim 5 wherein said bellows spring is of cylindrical shape.

8. The pump according to claim 5 wherein said bellows spring is provided perimetrally with at least one spiral rib.

9. The pump according to claim 1 wherein said at least one delivery duct consists of a tubular chamber made inside said tight piston.

10. The pump according to claim 1 wherein said valve means are arranged near the bottom of said suction and compression chamber and consist of a substantially flat main body provided on its periphery with elastic projecting spokes and substantially coplanar to the body, said main body being adapted to close said suction duct for the liquid.

11. The pump according to claim 1 wherein said valve means comprise to second piston slidingly coupled to said tight piston to which is fixed but vertically movable relative to the piston in order to prevent or allow inflow of said liquid into said tubular chamber.

12. The pump according to claim 1 wherein the coupling of said first and said second constraint means changes the bottom dead center of the stroke of said tight piston.

13. The pump according to claim 1 wherein the coupling of said fist and said second constraint means changes the top dead center of the stroke of said tight piston.

* * * * *